United States Patent [19]

Snow et al.

[11] 4,040,232

[45] Aug. 9, 1977

[54] BUILDING BRACE

[76] Inventors: Kenneth T. Snow, 1303 N. Cross St., Wheaton, Ill. 60187; Kenneth T. Snow, Jr., 317 Shagbark Court, Schaumburg, Ill. 60172

[21] Appl. No.: 539,701

[22] Filed: Jan. 9, 1975

Related U.S. Application Data

[63] Continuation-in-part of Ser. No. 449,324, March 8, 1974, abandoned.

[51] Int. Cl.[2] ..... E04C 3/32; E04C 3/18

[52] U.S. Cl. ..... 52/720; 52/657; 52/693; 52/738; 52/DIG. 6

[58] Field of Search ..... 52/377, 669, 720, 657, 52/DIG. 6, 737, 738, 633, 712, 735, 317, 693, 753 L

[56] References Cited

U.S. PATENT DOCUMENTS

| | | | |
|---|---|---|---|
| 811,003 | 1/1906 | Tudor | 52/738 |
| 1,105,183 | 7/1914 | Collins | 52/712 X |
| 1,428,881 | 9/1922 | Dyar | 52/317 |
| 2,130,049 | 9/1938 | Walker | 52/690 |
| 2,302,101 | 11/1942 | Boydstun | 52/657 X |
| 2,389,573 | 11/1945 | Balduf | 52/657 X |
| 2,856,646 | 10/1958 | Latimer et al. | 52/657 X |
| 3,025,577 | 3/1962 | Jureit | 52/753 L |
| 3,047,985 | 8/1962 | Murphy | 52/753 W |
| 3,049,042 | 8/1962 | De Lynn | 52/DIG. 6 |
| 3,390,494 | 7/1968 | Chappie | 52/712 X |
| 3,591,997 | 7/1971 | Tennison, Jr. et al. | 52/657 |

FOREIGN PATENT DOCUMENTS

| | | | |
|---|---|---|---|
| 141,397 | 2/1951 | Austria | 52/738 |
| 302,249 | 12/1952 | Switzerland | 52/DIG. 6 |
| 534,267 | 3/1941 | United Kingdom | 52/633 |
| 558,875 | 1/1944 | United Kingdom | 52/DIG. 6 |
| 340,412 | 1/1931 | United Kingdom | 52/720 |

*Primary Examiner*—Leslie Braun
*Attorney, Agent, or Firm*—Kenneth T. Snow

[57] ABSTRACT

An elongated steel member for diagonal attachment to and the bracing of the studding in a building wall without any notching of the studs preliminary to the use of the wall and before it has an outer sheathing mounted thereover. The brace is thin enough at its points of contact with the spaced apart building studs to permit an overlay of an outer wall to the studs without bulging. The formed and shaped brace is relatively deeply ribbed at its locations disposed between the studs and is either flat or relatively extremely shallow edge ribbed at the areas of contact with the studs to enable the brace to be relatively rigid throughout its length and giving the brace both compressive and tensile strength in its reinforcement of the wall.

1 Claim, 8 Drawing Figures

Fig. 4.
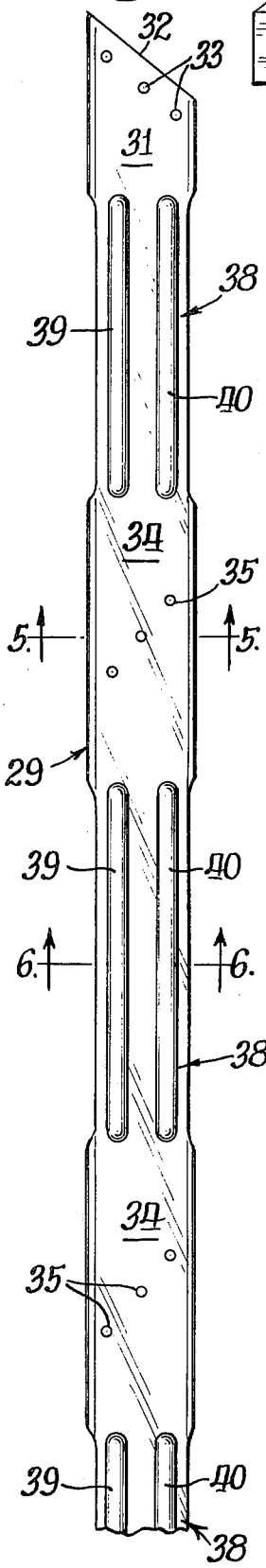
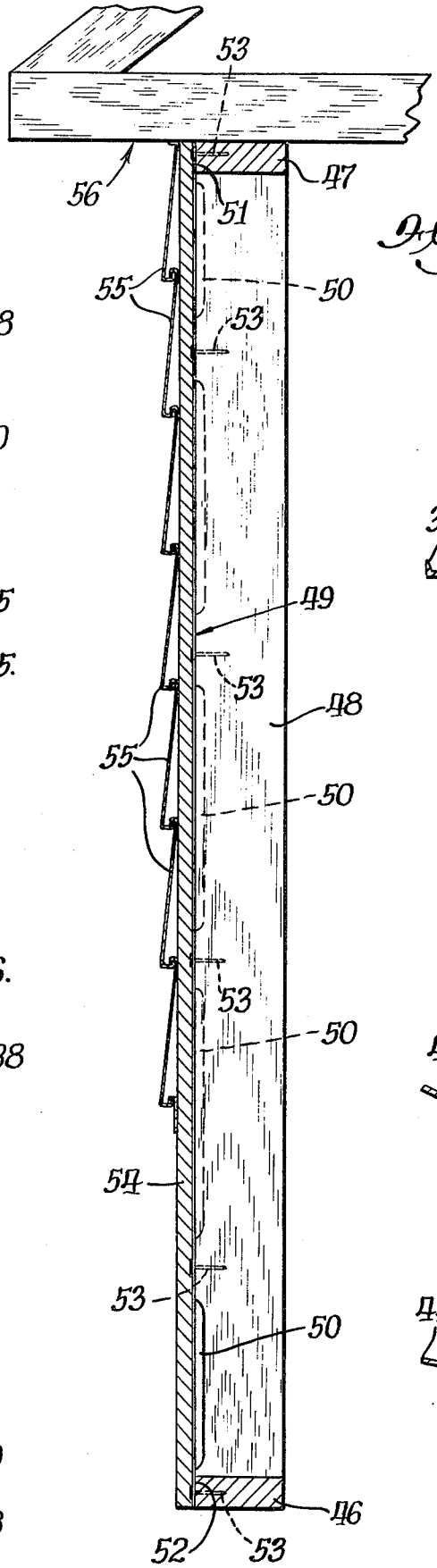
Fig. 3.
Fig. 5.
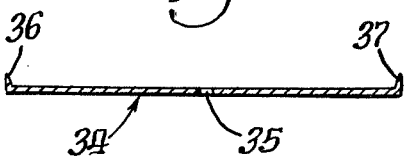
Fig. 6.
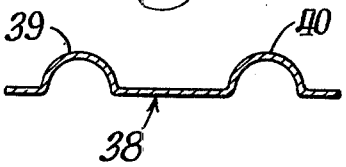
Fig. 7.
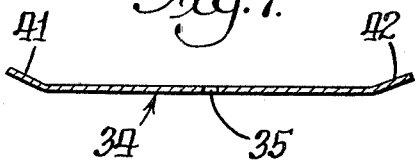
Fig. 8.
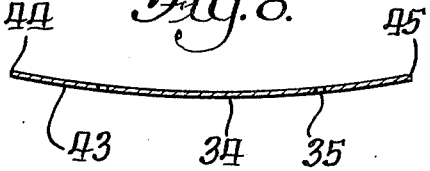

BUILDING BRACE

REFERENCE TO PRIOR APPLICATION

This application is a continuation-in-part of application Ser. No. 449,324, filed Mar. 8, 1974, now abandoned.

BACKGROUND OF THE INVENTION

1. Field of the Invention

Buildings constructed of a wood base are made of an assembly of wall sections. Each wall section is composed of a plurality of vertically disposed, spaced apart, parallel wooden studs which are fastened to a horizontally disposed wooden plate and a horizontally disposed wooden top plate. It is important that the studs remain vertical and at right angles relative to the bottom and top plates during completion of the building in order to keep the building squared. The studding is maintained in squareness by a diagonal brace which extends from the top wall plate, across a pluraltiy of studs and to the bottom plate. The present invention relates to such a brace.

2. Description of the Prior Art

The braces of the past have usually been made of wood and are generally a 1 nominal thickness board by several inches wide. The braces are customarily attached to the outside of the studding and in order to retain a smooth surface for the attaching of the outer wall thereover the brace is recessed within notches formed in the top and bottom wall plates as well as the studs. Thus the outer surface of the brace is flush with the outer surface of the wall defined by the studs and upper and lower connecting plate. The notching of the studs and plates is very time consuming and it is difficult to obtain a snug joint between the brace and the members the brace is joining and holding in proper relationship. The notches should be angular because of the diagonal disposition of the brace and unless great care is taken such an angular cut is almost impossible. In present construction methods the carpenters as a rule make parallel cuts in the studs and then with a hammer knock out the section between the cuts. This then forms the notch for the brace. But, as the brace is placed at an angle the notch at one side of the top and the other side of the bottom is considerably larger than necessary resulting in a sloppy joint and a greater than necessary weakening of the stud.

SUMMARY OF THE INVENTION

With this background of expensive labor construction and obtaining not too good a joint the brace of the present invention was developed. The new steel brace eliminates costly stud and plate notching and yet contains all of the attributes of the recessed wooden brace such as the equalling or surpassing of the wood in both compressive and tensile strengths. The present brace being of relatively thin strong steel is attached to the outer sides of the plates and studs without any prenotching of those wooden members by nails driven through holes provided in the brace. The brace is provided with relatively deep drawn ribs in those areas disposed between the spaced apart studs. These deep ribs extend inwardly of the spaced studs so they will not interfere with the superposing of an outer wall to the outer surface of the studs. In the areas of the brace abutting the studs the steel strip is left relatively flat to avoid interference with the attachment of an outer wall.

However, it is an important feature of this invention to have a brace, and not just a steel strap, which is relatively stiff from one end to the other to facilitate ease of handling and mounting by the user. Strip steel in the order of 18 gauge, although hard, will easily flex where it is not "worked." Here the inventors preferably provide a relatively shallow edge ribbing on the brace in those areas which span the longitudinal space between the deep ribs on the brace. The extremely shallow edge ribbing of various conformations project in the same direction as the deep ribs. The deep and shallow ribbing on the braces keeps the ribs the right stiffness and simultaneously provide a means to "set" the brace on the studs by themselves making slight indentations on the studs. The extremely shallow ribs are preferably driven into the back sides of the studs to thereby slightly dent the studs and thus to aid in locking the brace in fixed position relative to the wall but without any pre-notching of the studs. Simultaneously with the hammering of the back side of the brace against the studs nails are driven through the brace into the studs and plates and the fabricated skeleton wall is fixedly shaped. The result is of course a flush mounting of the elongated brace over the back side of the wall and an outer wall may easily be attached thereover without any bulges at the position of the braces despite the fact the studs have not been notched.

An important object of this invention is to provide a building brace of preformed steel which is easy to apply to a stud wall for effectively holding the wall in "squareness" preliminary to and subsequent to the attachment of an outer wall thereover and giving both compressive and tensile strength to the wall.

An object as set forth in the preceding object in which a do-it-yourselfer or handyman can utilize the brace of this invention as skillfully as an experienced carpenter.

An object as set forth in the preceding two objects in which the building brace of this invention makes possible the selling of entire building components in kit form whereby the purchaser may competently erect the building himself whether or not he has ever previously had building experience.

IN THE DRAWINGS

FIG. 3 is a vertical sectional view taken through a completed wall of a building and including the brace of this invention.

FIG. 4 is a plan view of a portion of the brace of this invention.

FIG. 5 is a sectional view taken on the line 5 — 5 of FIG. 4.

FIG. 6 is a sectional view taken on the line 6 — 6 of FIG. 4.

FIG. 7 is a sectional view similar to that of FIG. 5 but showing a modified form of brace stiffening.

FIG. 8 is another sectional view similar to that of FIG. 5 but showing a still further modified form of brace stiffening.

AS SHOWN IN THE DRAWINGS

Figure 1:
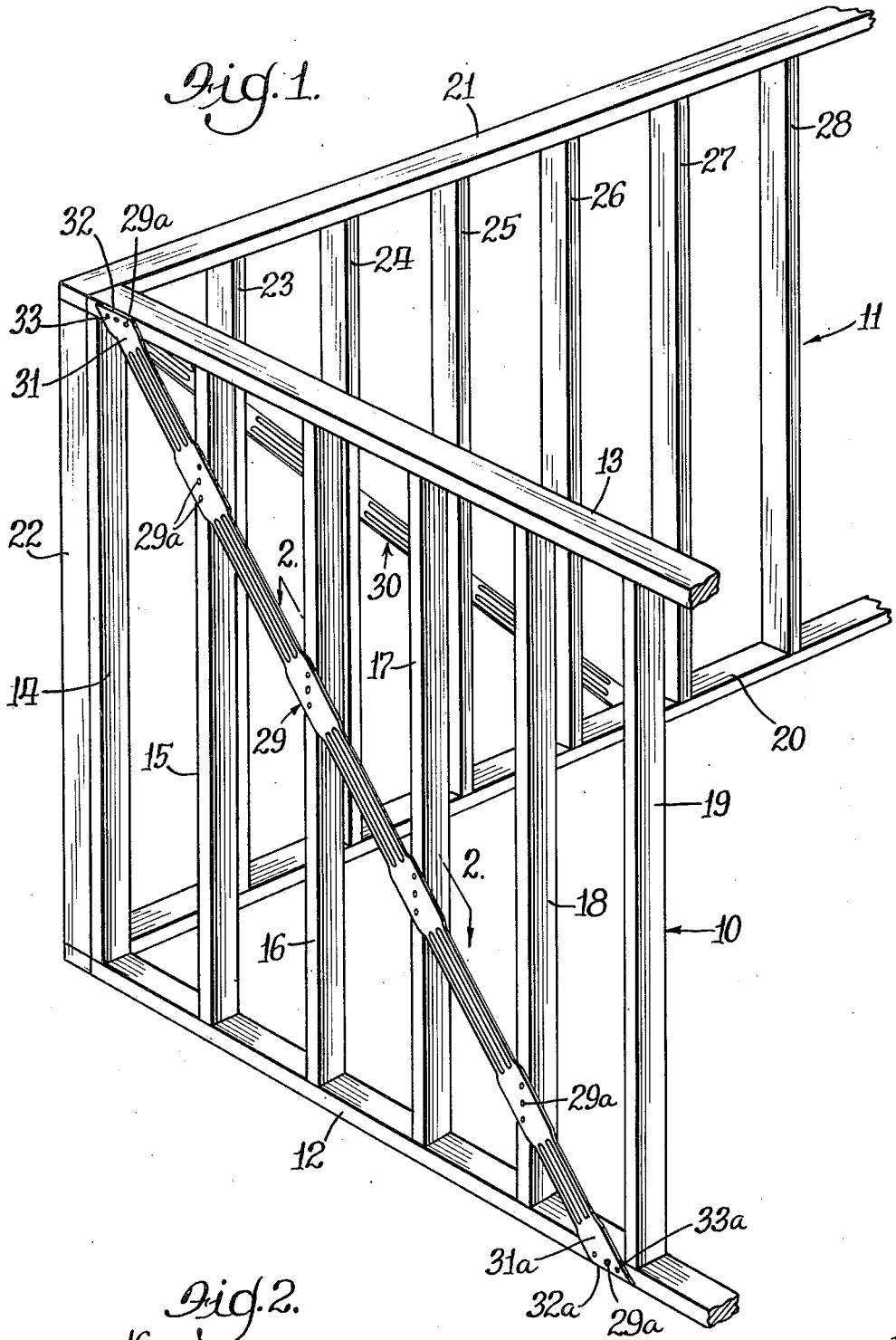
FIG. 1 is a perspective view of adjoining skeleton wall sections with the brace of this invention shown in both sections.

The reference numeral 10 indicates generally a first wall or skeleton of a wall of a building constructed primarily with wood. A second wall 11, similar to the wall 10, is disposed at right angles to and attached to the wall 10 as shown in FIG. 1.

The skeleton wall 10 comprises a wooden bottom plate 12, a wooden top plate 13 and a plurality of wooden, vertically disposed studs spanning the space between the bottom and top wall plates. The end stud 14 is located at the junction between the right angularly positioned walls 10 and 11. A plurality of laterally spaced apart studs 15, 16, 17, 18 and 19 lie parallel to the end stud 14 and constitute the remainder of the skeleton wall 10. There are many methods used to attach the studs to the top and bottom wall plates but primarily they are attached by driving nails through the plate members and into the ends of the studs. Such attachment means act to hold the basic wall structure rigid under a compression load applied at the top plate, but as against an upward pulling tension load or an endwise load the basic wall is relatively flimsy. If the bottom wall plate is anchored, an endwise load causes the studs to bend angularly relative to the bottom and top plates. The brace of the present invention is used in association with skeleton wall structures to give the wall great resistance to angular collapsing and an upward separation of the parts of the wall.

The skeleton wall 11 comprises a wooden bottom plate 20, a spaced apart wooden top plate 21, a vertical corner stud 22, and a plurality of laterally spaced apart vertical studs 23, 24, 25, 26, 27 and 28. These wooden elements are fastened together in the same manner as for wall 10 and hence have the same characteristic weaknesses of wall 10.

An elongated, preformed steel brace 29 is diagonally positioned over the outside of the skeleton wall 10. Nails **29*a* are used to fasten the brace 29 to the top plate, the bottom plate and the intermediate studs. The preformed steel brace, so diagonally positioned, gives the basic wooden wall structure rigidity and resistance to collapse from compressive forces as well as tensile forces and acts to hold the wall secure from forces exerted in any and all directions. Another and similar elongated, preformed steel brace 30 is diagonally positioned over the outside of the skeleton wall 11. The brace 30** is fastened by nails (not shown) driven through holes in the brace and into the wooden bottom and top plates and the included vertical studs. Here again the brace locks the wooden component members of the wall in fixed relationship with each other.

The preformed brace 29 is shown in an enlarged plan view of FIG. 4. Because of the size, portions of the lower end of the brace in FIG. 4 are broken away. However, the brace is generally symmetrical about its center as shown in FIG. 1 so the bottom appears the same as the top of the brace. The top portion of the brace 29 is designated by the numeral 31. The top end portion 31 is flat and as the brace is made of a thin strip of steel preferably galvanized, it may and does abut flush against the outer surface of top wall plate 13 without any notching of that top wall plate. The lower bottom end of the brace 29, as shown in FIG. 1, is designated by the numeral **31*a* and is flat in the same manner as the top 31. Because the brace is able to give its greatest support to the wall in a diagonal disposition the top 31 is preferably cut off at an angle as shown as 32 so that the top of the brace is permitted to lie flush with the top edge of the top plate 13. The bottom flat end 31*a* is preferably angularly cut as shown at 32*a*. The angular cut offs of the top and bottom are opposite to one another so that the lower end of the brace will be flush with the lower edge of the bottom plate 12. A plurality of nail holes 33 are provided in the flat top end portion 31 to permit nailing of the brace to the top wall plate 13. Similarly a plurality of nail holes 33*a* are provided in the flat bottom end portion 31*a* to permit nailing of the brace to the bottom wall plate 12** without any notching of that bottom wall plate.

The brace is made of a steel strip in the order of 18 gauge galvanized steel with the width being in the order of 3½ inches. These specifications are suggestive only and not intended to be limiting. Obviously the brace would be effective with other steel thicknesses and widths. However, the length of the brace coupled with the thinness of the steel from which it is made means that unless other provisions were made it would easily flex and be nothing more than a steel strap having only tensile strength. As described above the steel brace of this invention replaces a previously used stiff, thick wooden brace which was applied to notches in the studs so that the outer surface was smooth and unimpaired for the attachment thereover of outer sidings. Now, with the thin steel no notching of studs is required but the steel must be retained relatively flat at the position of engagement with top and bottom plates and the intermediate studs. As already described the top and bottom 31 and **31*a* are flat. Between the ends 31 and 31*a* there are alternately two types of portions comprising the brace. One such portion engages or abuts the studs while the other portions are disposed between the spaced apart studs. The portions which engage the outer edges of the vertical studs are designated by the numeral 34. These portions 34 are spaced longitudinally of the brace 29 and are generally flat. Nail holes 35 are provided in the central sections of the portions 34 and thus permit nailing of the brace to the studs without any notching of those studs. It is preferably desirable to "work" the metal in the portions 34 to give the brace stiffness and resistance to easy flexing primarily during handling. As shown in the sectional view of FIG. 5 the side edges of the brace 29 are provided with extremely shallow or relatively short ribs 36 and 37. These extremely shalllow ribs are disposed toward the studs so that when the brace is nailed through the holes 35** to the stud the shallow side ribs are simultaneously driven against the wooden surface causing it to slightly dent. This performs the dual function of further fixing and locking the brace to the stud and aids in maintaining the thinness of the brace at the point of contact with the stud. There are thus no projections on the outside of the studding despite the fact the studs have not been notched. There is thus nothing to prohibit the fastening of an outer siding over the studs and certainly nothing present which would cause a bulge in the siding. Yet, the extremely shallow ribs perform the desirable function of keeping the brace stiff through those portions engaging the studs and particularly makes the brace stiff enough for easy handling by a single person when it is assembled onto the stud wall.

Figure 2:
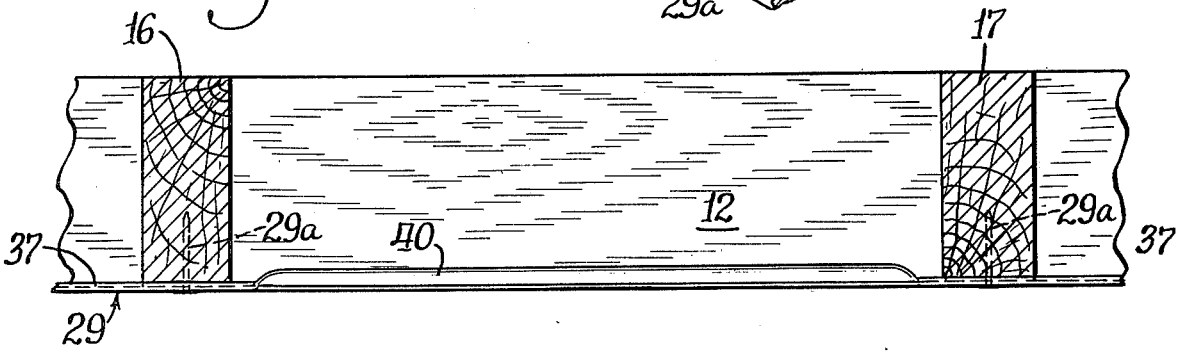
FIG. 2 is a sectional view taken on the line 2 — 2 of FIG. 1.

The alternate portions of the brace lying between the portions 34 and between the vertical wall studs are shown at 38. Each portion 38 is equipped with side-by-side relatively deep drawn ribs 39 and 40. Here again the deep ribs are a "working" of the metal causing its substantial stiffening. Thus the brace of this invention is generally stiff from one end to the other and yet is generally flat in those portions where it is necessary to have nailing attachment of the brace to the wall. The deep ribs 39 and 40 are located in the brace between the studs as illustrated so dramatically in the enlarged sectional view of FIG. 2. The ribs 39 and 40 are positioned on the brace centrally between the side edges. Also, It is important to note the ribs 39 and 40 extend inwardly of the studs thereby insuring that the outer surface of the brace presents a smooth non-projecting surface on the outside of the wall. The sectional view of FIG. 6 clearly illustrates the deep drawn ribs 39 and 40.

FIG. 7 shows a modified form of the stud engaging portions 34. This view is a cross sectional view comparable to FIG. 5. In this view the side edges 41 and 42 are bent at a shallow acute angle to the flat center portion rather than the sharp or almost right angular bent shallow ribs 36 and 37 of FIG. 5. Thus the brace with the portions 34 in the form of FIG. 7 are effectively stiffened by the extremely shallow edge bendings and yet when the brace is hammered against the stud causing it to slightly dent at the time of inserting nails therethrough the outer surface becomes substantially flat.

FIG. 8 shows a still further modified form of the stud engaging portions 34. Here the brace is extremely shallow dished to give it stiffness. The side edges 44 and 45 defined by the extremely shallow dishing are directed toward the studs. Again, when nails are driven through the brace and into the studs the shallow side edges 44 and 45 dig into the wood making slight dents therein and the brace flattens at those points.

A construction worker may thus pick up the braces 29 and 30 of this invention and handling is easy because the braces do not flop around. The braces are generally stiff throughout their lengths. After the braces have been nailed to the skeleton walls it is immaterial that the portions engaging the studs may have been flattened as together the wood and steel are very rigid. The steel braces of this invention lock the wooden wall members in properly fixed relationship. The ribs of FIGS. 5, 7 and 8 are all of the extremely shallow type to avoid having any substantial thickness outside the studs. Between the studs the deep ribs 39 and 40 give the brace real strength and rigidity in all directions. The stud wall made with the preformed brace of this invention not only gives all the tensile strength of the steel but also adds compressive strength primarily because of the deep drawn ribs located between each of the adjacent spaced apart studs.

As best shown in FIG. 3 a complete wall is depicted with the brace of this invention mounted therein. Here the wall includes a wooden bottom plate 46, an upwardly spaced apart top plate 47, and intermediate, laterally spaced apart studs 48. A brace 49, of preformed steel, identical to the braces 29 and 30, is mounted diagonally over the outside of the studs and their adjoining upper and lower plates. The preformed brace 49 is equipped with deep drawn strengthening ribs 50 which project inwardly between the studs to add substantial compressive strength to the brace. The top 51 of the brace 49 abuts the top plate 47 and the bottom 52 of the brace abuts the bottom plate 46. Nails 53 hold the brace to the top and bottom plates and the intermediate studs of the wall. And again, the brace 49 is relatively stiff throughout its length by the alternate deep shallow ribbing projecting in the same direction. Thus the outer surface of the brace remains smooth and flat so that an outer wall may be attached to the outside of the skeleton wall without any bulging and obviously without any notching of the wooden members to which is attached. The wall of FIG. 3 includes sheet insulation 54 which is nailed, stapled or otherwise fastened to the outer surface of the basic wood wall. This insulation 54 is placed directly over the flat outward surface of the steel brace 49. The wall of FIG. 3 also shows a shingled siding 55 fastened over the sheet insulation 54. A roof 56 is shown mounted on top of the wall of FIG. 3.

The brace of this invention is simple to apply when the wood wall is in skeleton form as illustrate in FIG. 1. There is no need for costly stud notching as was previously necessary for all earlier type braces which had compressive resisting qualities as well as tensile resisting qualities and certainly when wood braces were used. Also, the studs are not weakened by notching but rather they remain at full strength with the brace being attached directly to the outside of the studs. The flat exterior of the preformed diagonally positioned rigid steel braces permits the easy attachment of an outer wall thereover as shown in FIG. 3.

We are aware that many details of construction may be varied over a wide range without departing from the principles of this invention and it is urged the patent granted hereon will not be limited except by the scope of the appended claims.

What is claimed is:

1. An elongated, relatively thin steel brace having both substantial compressive and tensile strengths for use in a building having a basic wall composed of vertically disposed spaced apart wood studs joined by a horizontal wooden bottom plate and a horizontal wooden top plate and capable of being carried and handled by a person without substantial bending, and with the brace intended for attachment to the basic wall in a diagonal manner from the top plate, across a plurality of the vertical studs to the bottom plate without requiring notching of the top and bottom plates or the intermediately disposed vertical studs, said elongated brace comprising relatively flat portions at each end thereof with a plurality of holes therethrough to permit nailing of the flat end portions to the spaced apart top and bottom plates without any wood notching, said brace having a plurality of first portions disposed in spaced apart relationship longitudinally of said brace and between the flat ends for disposition of said first portions between the vertically disposed studs, stiffening ribs in each of said first portions, said ribs disposed generally longitudinally of the brace and projecting in one direction from the plane of said brace for disposition inwardly between the studs leaving the outside thereof generally flat and lying in the same plane as the outer plane surface of the studs, said ribs projecting a distance from the plane of said brace sufficient to substantially prevent compressive bending of said first portions, and said brace having other intermediate portions extending between the ends of said first portions for abutting each of the studs which the brace crosses, said intermediate portions being equal in number to the number of studs intended to be crossed by said brace, said intermediate portions being shaped in transverse cross section to render said intermediate portions in cooperation with said first portions and said flat end portions sufficiently stiff to permit carrying of said brace by a person without substantial bending and further to enable said intermediate portions to engage said studs in a substantially flat condition when said brace is secured to said basic wall with the ribs of said first portions extending inwardly of a plane including the outer edges of said basic wall, said portions having a plurality of nail holes provided therein, said intermediate portions of the brace shaped with extremely shallow stiffening ribs at the longitudinal side edges of said intermediate portions, said shallow stiffening ribs projecting in the same direction as said ribs of said first portions, said intermediate portions of said brace being curvilinear in cross section about the longitudinal axis of said brace to thereby define the extremely shallow side edge stiffening ribs.

* * * * *